United States Patent [19]

Seidel

[11] Patent Number: 4,624,518

[45] Date of Patent: Nov. 25, 1986

[54] ELECTRICAL CONNECTOR

[75] Inventor: Udo Seidel, Hamburg, Fed. Rep. of Germany

[73] Assignee: Minnesota Mining and Manufacturing Company, St. Paul, Minn.

[21] Appl. No.: 780,220

[22] Filed: Sep. 26, 1985

[30] Foreign Application Priority Data

Oct. 16, 1984 [DE] Fed. Rep. of Germany ..... 3437829

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 4,431,247 2/1984 Aldullah et al. ..... 339/97 P

*Primary Examiner*—Joseph H. McGlynn

*Attorney, Agent, or Firm*—Donald M. Sell; James A. Smith; Terryl K. Qualey

[57] ABSTRACT

An electrical connector having a hollow cylindrical contact element with two circumferential wire connecting slots. A cap rotatable about the contact element and has a transverse channel for receiving an insulated wire end to carry it into a first of the wire connecting slots upon rotation of the cap. A tubular sleeve is also rotatable about the contact element and has a transverse channel for receiving an insulated wire end to carry it into the second wire connecting slot upon rotation of the tubular sleeve. A locking mechanism locks the tubular sleeve after rotation to its wire connecting position.

9 Claims, 5 Drawing Figures

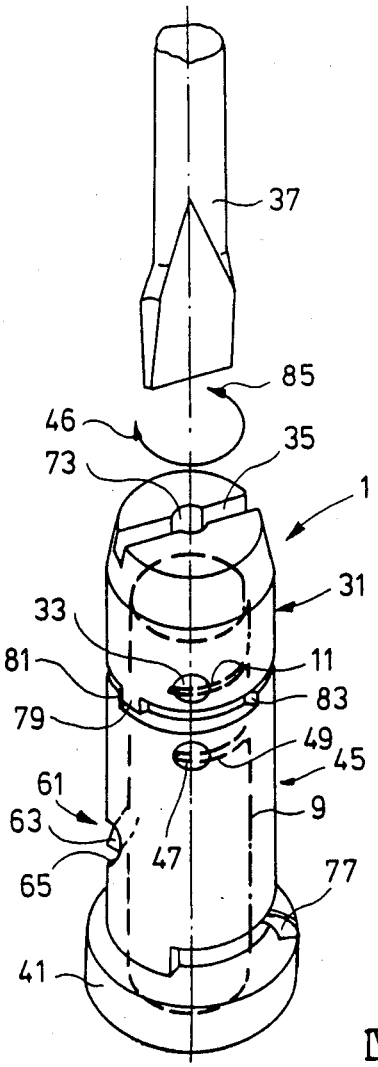
FIG. 1
FIG. 2
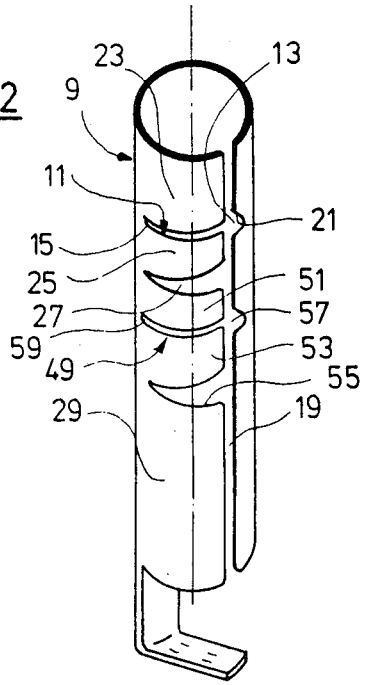
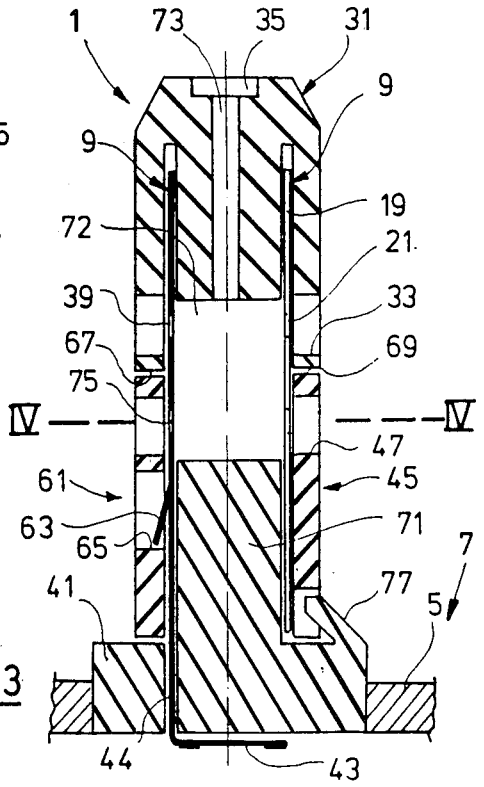
FIG. 3

ELECTRICAL CONNECTOR

FIELD OF THE INVENTION

The present invention relates to an electrical connector for connecting two insulated electrical wires.

BACKGROUND OF THE INVENTION

Telephone terminal blocks usually have a large number of connectors mounted on a distributor base plate. These connectors conncet incoming telephone lines (main wires) with outgoing lines (switching wires). U.S. Pat. No. 4,431,247 discloses an electrical connector for this purpose having a hollow cylindrical contact element with a circumferential wire connection slot and a cap rotatable about the contact element and having a transverse wire channel for receiving an outgoing wire end and for carrying it into the wire connection slot upon rotation of the cap. The end of the cylindrical contact element opposite the cap is attached to an electrically insulating support stud which forms a part of the distributor base plate. A contact-lug extends from the end of the contact element through an opening in the support stud to the bottom side of the distributor base plate, where it may be connected to one of the incoming lines. Above the distributor base plate, an outgoing line can be readily connected or disconnected by rotation of the cap. Each time an alteration of the circuitry powered by the outgoing line wires is needed, the connections of the outgoing lines have to be changed, while the incoming line connections may remain unchanged. Therefore, the lower part of the distributor base plate is in most practical situations prepared as a box-like structure permanently filled with a sealing compound to securely protect the connections of the incoming lines. The casting of this sealing compound is usually done in the factory, in which case the connecting elements for the incoming lines are formed as short conductor stubs with a coupling adapter at their ends. The arriving incoming line wires will, then, be connected to a matching counter-adapter and the two adapter pieces will be connected with each other. However, if incoming line wires have to be exchanged, a changing of wires is necessary at both adapter pieces and such an exchange at the location of use is difficult.

In many telecommunication systems it is necessary to switch incoming line wires (main wires in a distributor or to connect the incoming line wires directly to the distributor without the intermediate connections of adapter pieces. In these cases, the connector of U.S. Pat. No. 4,431,247 is not suitable.

The electrical connector of the present invention has a hollow cylindrical electrically conductive contact element, a cap and a tubular sleeve of an electrically insulating material and a locking mechanism. The contact element has a pair of parallel wire connection slots extending in a circumferential direction, each wire connection slot extending from a relatively wide insertion area to a narrow insulation cutting and wire core connection clamping area. The cap is positioned over said contact element and has a first transverse channel in axial alignment with a first of the wire connection slots in the contact element for receiving the end of an insulated electrical wire. The cap is rotatable about the contact element between an insertion position and a wire connection position whereby the first transverse channel is aligned with either the wire insertion area or the clamping area of the first wire connection slot. The tubular sleeve is fitted on said contact element and has a second transverse channel in axial alignment with the second of the wire connection slots in the contact element for receiving the end of an insulated electrical wire. The tubular sleeve is rotatable about the contact element between an insertion position and a wire connection position whereby the second transverse channel is aligned with either the wire insertion area or the clamping area of said second wire connection slot. The locking mechanism is provided for locking the tubular sleeve in its wire connection position. The electrical connector of the present invention permits a simple, exchangeable connection of the incoming line wires as well as the outgoing line wires without significant additional space requirements.

THE DRAWING

FIG. 1 is a perspective view of a connector according to the invention;

FIG. 2 is a perspective view of the contact element used in the connector of FIG. 1;

FIG. 3 is an axial cross-sectional view of the connector;

DESCRIPTION OF THE PREFERRED EMBODIMENT

Figure 4:
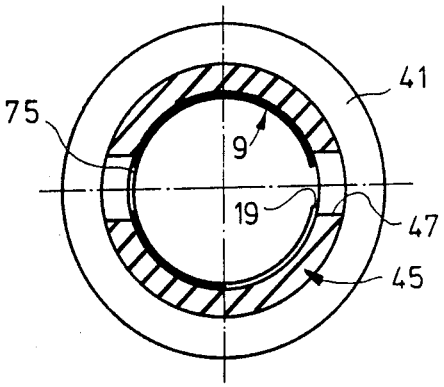
FIG. 4 is a cross-sectional view taken along line IV—IV of FIG. 3.
Figure 5:
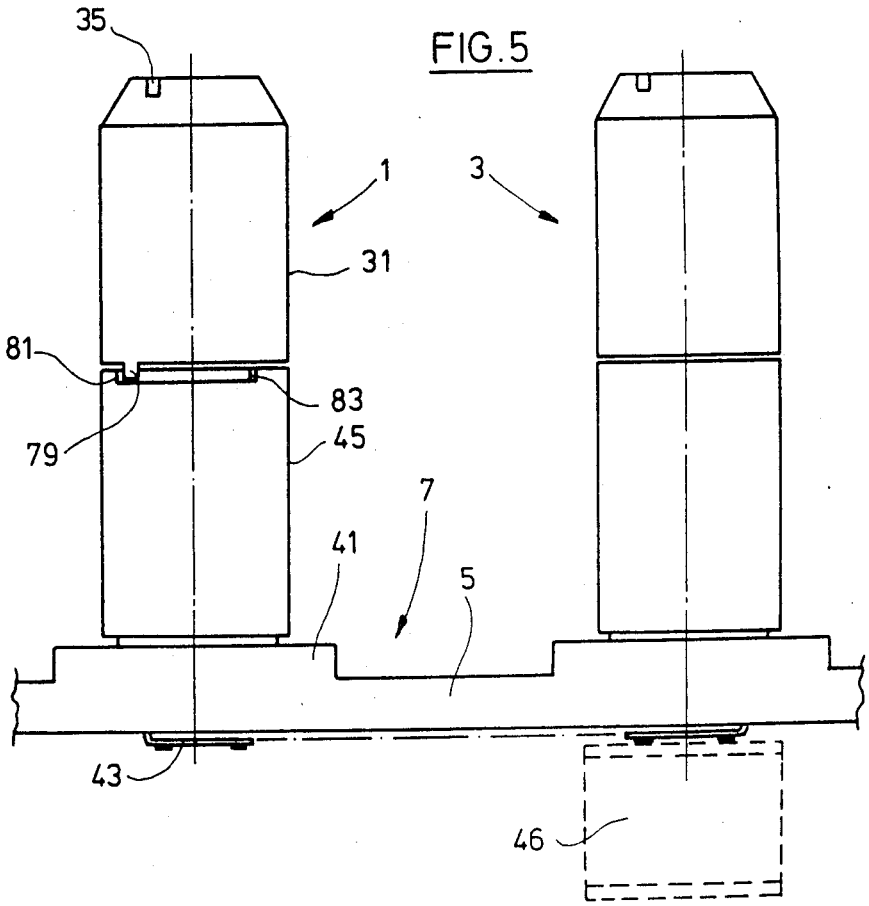
FIG. 5 is a side elevation view of two connectors according to the invention.

The connector 1 of the present invention consists of a hollow cylindrical contact element 9 made of an electrically conductive spring-hard material, for example spring-bronze. The contact element 9 has a wire connection slot 11 extending in an essentially circumferential direction, whereby the slot extends from a relatively wide insertion area 13 to a narrow clamping area 15. The illustrated contact element 9 has been produced by bending a flat, cut metal sheet, whereby a full-length slot 19 in the axial direction is formed. The wire connection slot 11 originates with its wider insertion area 13 in the axial slot 19. At the opposite edge of the axial slot 19 of the contact element 9 across from the wire connection slot 11, a recessed notch 21 is cut to enlarge the insertion area 13 still further. The areas 23 and 25 of the contact element 9 adjacent to the wire connection slot 11, are partially separated from the remaining areas 29 of the contact element 9 by a separating slot 27 for permitting a spring-like motion of these areas independent from the remaining areas.

One axial end of the contact element 9 is covered by a cap 31, which extends over the wire connection slot 11 and has a transverse channel 33 in the axial location of the clamping slot 11 for receiving the end of an insulated electrical wire (not shown) to be connected. The cap 31 is fitted onto the contact element 9 and can be turned between an insertion position (FIG. 3) and a wire connection position (FIG. 1), whereby the transverse channel 33 is either aligned over the insertion area 13 or the clamping area 15 of the wire connection slot 11. In principle, the cap 31 can be turned in either direction. In the illustrated embodiment the top area of the cap has a profiled slot 35 for inserting a suitable rotating tool, in this case a common screwdriver 37. Therefore, the cap can be effortlessly turned by means of an always readily available tool. In regard to the electrical line wires to be connected (not shown in the drawings), the wire connection slot 11 is dimensioned and prepared with spring properties in such a way that a forceful inserting of the line wire into the clamping slot 11 is achieved by turning the cap 31, after the wire has been inserted into the insertion area 13 of the clamping slot 11 via the transverse channel 33 while the cap 31 was in the insertion position (FIG. 3), and to permit also a cutting of the wire insulation, whereby the conductive core of the wire is conductively and firmly connected in the clamping area (15).

The contact element 9 is also provided with a shear opening 39 located diametrically opposite to the insertion area 13 of the clamping slot 11 and the transverse channel 33 is fully extended through the cap to form in combination with the shear opening 39 an effective shearing system if the cap 31 is turned, whereby the excessive length of the inserted wire is sheared off during the wire connection.

The end of the contact element 9 opposite the end covered by the cap 31, is attached to a support stud 41 which forms a part of the distributor base 5. This type of attachment is particularly simple. The contact element 9 has a contact lug 43 which extends through an opening 44 in the support stud 41 to the other side of this support. In this manner, a connection to the contact element 9 can readily be made from below the support stud. The contact lug 43 is bent beneath the support stud 41, thereby forming a contact area for connecting other electrical devices 46. Also, the bending of the contact lug 43 assures a secure seating to prevent a separation of the contact element 9 from the support stud 41.

A tubular sleeve 45 is fitted on the contact element 9. This sleeve 45 can also be turne and has a second transverse channel 47 for inserting the end of an insulated electrical wire. The contact element 9 contains also a second wire connection slot 49 extending in the circumferential direction. This wire connection slot originates also in the axial slot 19 in the same way as the first wire connection slot 11. Furthermore, the second wire connection slot 49 is also surrounded by areas 51, 53 which are partially separated from the remaining areas of the contact element 9 by separating slots 27 and 55, respectively, to permit a spring-like motion.

The tubular sleeve 45 can be turned between an insertion position (FIG. 3) and a wire connection position (FIG. 1), whereby the second transverse channel 47 is either aligned over a widened insertion area 57 or a narrowed clamping area 59 of the wire connection slot 49. A locking mechanism 61 is provided for locking the tubular sleeve 45 in its wire connection position.

With the tubular sleeve 45 in the insertion position, an end of the incoming line wire (not shown) is inserted into the insertion area 57 of the second wire connection slot 49 by passing the wire through the second transverse channel 47 and the tubular sleeve 45 is, then, turned in the clockwise direction 46 until being locked in the wire connection position (FIG. 1). In this process, the insulation of the inserted line wire is at first cut and penetrated and, then, the conductive core of the wire is conductively connected and clamped. Since the tubular sleeve 45 is firmly locked in its position, the cap 31 can be rotated counterclockwise 85 (FIG. 1) to its insertion position, the outgoing line wire (not shown) inserted into the first transverse channel 33 and the cap again rotated clockwise to connect the outgoing line wire (not shown) in the first wire connection slot 11. If necessary, the outgoing line may be changed by turning the cap 31 and exchanging wires. Therefore, the described connector permits an easy connection of an incoming line wire (main wire) without any undesirable additional requirements in regard to space and constructional parts and without an interfering with the accustomed usability of the connector in regard to an easy connecting and disconnecting of the outgoing line wires (switching wires).

In the illustrated embodiment, the locking mechanism can be unlocked as desired. This offers the advantage, that the incoming line wire (main wire) can also be exchanged. The locking mechanism consists of a spring-latch 63 bent out of the contact element 9 and a corresponding lock opening 65 in the tubular sleeve 45. The spring-latch 63 can be pushed aside, for instance, by a tool inserted through the lock-opening 65 and the unlocking is accomplished by turning the tubular sleeve 45. Furthermore, the spring-latch 63 presents also a test-contact readily accessible from the outside.

In the illustrated embodiment the tubular sleeve 45 is between the support stud 41 and the cap 31. For the purpose of facilitating the turning motion, the contacting surfaces of the cap and the support stud are each sliding bearing surfaces 67 and 69, respectively. This arrangement best utilizes the axially available space and permits an easy access to the cap 31 as well as to the tubular sleeve 45.

The tubular sleeve 45 is made of an electrically insulating material to provide an electrical insulation of the contact element 9 and to permit a voltage-free access to the tubular sleeve. For the same reason, the cap 31 and the support stud 41 are also made from an electrically insulating material.

The support stud 41 has a column 71 reaching into the interior of the contact element 9 beyond the outwards bent spring-latch 63, whereby the stuctural stability of the assembled connector is improved and the interior of the contact element 9 is largely sealed from external effects permitting a filling of the interior with a protective filler material 72. A filling opening 73 is provided in the cap 31 for filling the filler material into the interior of the contact element 9.

For shearing off an excessive length of the wire during the clamping in the second wire connection slot 49, the contact element 9 has a shear opening 75 located diametrically opposite the insertion area 57 of the second wire connection slot 49. A second transverse channel 47 extends through the tubular sleeve 45 forming in combination with the second shear opening 75 an effective second shearing mechanism, if the tubular sleeve 45 is turned.

The insertion position for the tubular sleeve 45 is defined by a stop barrier 77 which is a part of the support stud 41. This feature facilitates the insertion of a line wire to be connected. The tubular sleeve 45 is rotatable over its path between its insertion and wire connection positions with the cap 31, thereby avoiding a special application of force to the tubualr sleeve 45. Therefore, both wire connection steps can be carried out in sequence by turning the cap 31. At first, an incoming line wire (main wire) is inserted and connected in the second wire connection slot by turning the cap 31, whereby the tubular sleeve 45 is also rotated. After the tubular sleeve 45 is snapped into its locked position, the cap 31 can be turned back in its insertion position to permit an insertion of an outgoing line wire (switching wire) in the first wire connection slot 11 and the wire connection is achieved in the same way by a renewed turning of the cap 31 into the wire connection position.

The simultaneous turning of the tubular sleeve 45 and the cap 31 is simply achieved by means of a stop-barrier effective in the wire connection direction. But the return motion of the cap 31 can also be limited by a stop-barrier, whereby the insertion position of th cap 31 is defined. These types of stop-barriers are present on the contacting radial surfaces of the cap 31 and the tubular sleeve 45. The cap 31 has an axial stud 79 which interacts on either of its sides with both stop barriers 81 and 83, of the tubular sleeve 45. If an incoming line wire is to be exchanged, a turning of the cap 31 in the counterclockwise direction 85 by using, for instance, a screwdriver 37 as illustrated, will at first result in the release of the outgoing line wire (not shown) in the cap 31 and then, after releasing the locking mechanism 61, in the release of the incoming line wire (not shown) in the tubular sleeve 45. The presence of the locking mechanism 61 effectively prevents an accidental loosening of the incoming lines during the more frequently required exchanging of outgoing lines. On theother hand, since the rarely occurring exchanging of incoming lines by means of the tubular sleeve 45 also usually requires an exchanging of the corresponding outgoing line wires, it is advantageous to disconnect both line wires with the ame turning motion during the described counterclockwise rotation.

I claim:

1. An electrical connector comprising:

a hollow-cylindrical, electrically conductive contact element having a pair of parallel wire connection slots extending in a circumferential direction, each wire connection slot extending from a relatively wide insertion area to a narrow insulation cutting and wire core connection clamping area, a cap of an electrically insulating material over said contact element having a first transverse channel in axial alignment with a first of said wire connection slots in said contact element for receiving the end of an insulated electrical wire, said cap being rotatable about said contact element between an insertion position and a wire connection position whereby the first transverse channel is aligned with either the wire insertion area or the clamping area of said first wire connection slot, a tubular sleeve of an insulating material fitted on said contact element and having a second transverse channel in axial alignment with the second of said wire connection slots in said contact element for receiving the end of an insulated electrical wire, said tubular sleeve being rotatable about said contact element between an insertion position and a wire connection position whereby the second transverse channel is aligned with either the wire insertion area or the clamping area of said second wire connection slot, and a locking mechanism for locking said tubular sleeve in its wire connection position.

2. A connector according to claim 1 wherein the end of said contact element opposite the end covered by said cap, is attached to an electrically insulated support stud, said tubular sleeve is positioned between said support stud and said cap and said support stud and said cap each have a sliding bearing surface in contact with said tubular sleeve.

3. A connector according to claim 1 wherein said insertion position of said tubular sleeve is defined by a stop barrier.

4. A connector according to claim 1 wherein said contact element has a first shear opening diametrically opposite said insertion area of said first wire connection slot and a second shear opening diametrically opposite said insertion area of said second wire connection slot and said first transverse channel extends through said cap and said second transverse channel extends through said tubular sleeve, each said transverse channel forming in combination with its associated shear opening an effective shearing device for cutting off the ends of wires extending through the transverse channels when said cap and said tubular sleeve are rotated from their insertion positions to their connection positions.

5. A connector according to claim 1 wherein said tubular sleeve can be rotated from its insertion position to its wire connection position by turning said cap and, after said tubular sleeve is locked in its wire connection position, said cap can be rotated back to its insertion position.

6. A connector according to claim 1 wherein said contact element is attached at its end opposite said cap to an electrically insulated support stud, said contact element has a contact lug extending through an opening in said support stud to the other side of said support stud, and said contact lug is bent beneath the bottom side of said support stud thereby forming a contact area for connecting other electrical devices.

7. A connector according to claim 1 wherein said locking mechanism can be unlocked as desired.

8. A connector according to claim 7 wherein said locking mechanism consists of a spring-latch bent out of the contact element and a corresponding lock-opening in the tubular sleeve and can be unlocked by depressing the spring-latch and turning the tubular sleeve.

9. A connector according to claim 8 wherein said spring-latch forms a test-contact accessible through the lock-opening.

* * * * *